US006473710B1

(12) United States Patent
Eryurek

(10) Patent No.: US 6,473,710 B1
(45) Date of Patent: Oct. 29, 2002

(54) LOW POWER TWO-WIRE SELF VALIDATING TEMPERATURE TRANSMITTER

(75) Inventor: Evren Eryurek, Minneapolis, MN (US)

(73) Assignee: Rosemount Inc., Eden Prairie, MN (US)

( * ) Notice: Subject to any disclaimer, the term of this patent is extended or adjusted under 35 U.S.C. 154(b) by 31 days.

(21) Appl. No.: 09/606,259

(22) Filed: Jun. 29, 2000

Related U.S. Application Data

(60) Provisional application No. 60/141,963, filed on Jul. 1, 1999.

(51) Int. Cl.[7] ..... G08C 19/02

(52) U.S. Cl. ..... 702/133; 702/182; 702/183; 374/183; 700/79

(58) Field of Search ..... 702/130, 133, 702/136, 104, 107, 99, 183, 184, 182, 176, 177; 700/79; 374/183, 208, 210; 709/201, 238; 324/238, 541, 713; 714/1, 37, 38

(56) References Cited

U.S. PATENT DOCUMENTS

| | | | | |
|---|---|---|---|---|
| 3,096,434 | A | 7/1963 | King | 235/151 |
| 3,404,264 | A | 10/1968 | Kuger | 235/194 |
| 3,468,164 | A | 9/1969 | Sutherland | 73/343 |
| 3,590,370 | A | 6/1971 | Fleischer | 324/51 |
| 3,688,190 | A | 8/1972 | Blum | 324/61 R |
| 3,691,842 | A | 9/1972 | Akeley | 73/398 C |
| 3,701,280 | A | 10/1972 | Stroman | 73/194 |
| 3,973,184 | A | 8/1976 | Raber | 324/51 |
| RE29,383 | E | 9/1977 | Gallatin et al. | 137/14 |
| 4,058,975 | A | 11/1977 | Gilbert et al. | 60/39.28 |
| 4,099,413 | A | 7/1978 | Ohte et al. | 73/359 |
| 4,102,199 | A | 7/1978 | Talpouras | 73/362 |
| 4,122,719 | A | 10/1978 | Carlson et al. | 73/342 |
| 4,249,164 | A | 2/1981 | Tivy | 340/870.3 |
| 4,250,490 | A | 2/1981 | Dahlke | 340/870.37 |
| 4,337,516 | A | 6/1982 | Murphy et al. | 364/551 |
| 4,399,824 | A | 8/1983 | Davidson | 128/736 |
| 4,517,468 | A | 5/1985 | Kemper et al. | 290/52 |
| 4,528,869 | A | 7/1985 | Kubo et al. | 74/695 |

(List continued on next page.)

FOREIGN PATENT DOCUMENTS

| | | |
|---|---|---|
| DE | 32 13 866 A1 | 10/1983 |
| DE | 35 40 204 C1 | 9/1986 |
| DE | 40 08 560 A1 | 9/1990 |

(List continued on next page.)

OTHER PUBLICATIONS

U.S. patent application Ser. No. 09/852,102, Eryurek et al., filed May 09, 2001.

(List continued on next page.)

*Primary Examiner*—Kamini Shah
(74) *Attorney, Agent, or Firm*—Westman, Champlin & Kelly, P.A.

(57) ABSTRACT

A two-wire temperature transmitter is coupleable to a two-wire process control loop for measuring temperature of a process. The transmitter includes an analog to digital converter configured to provide digital output in response to an analog input. A two-wire loop communicator is configured to couple to the process control loop and send information on the loop. A microprocessor is coupled to the digital output and configured to send temperature related information on the process control loop with the two-wire loop communicator. A power supply is configured to completely power the two-wire temperature transmitter with power from the two-wire process control loop. A temperature sensor comprises at least two temperature sensitive elements having element outputs which degrade in accordance with different degradation characteristics. The element outputs are provided to the analog to digital converter, such that the microprocessor calculates temperature related information as a function of at least one element output from a first temperature sensitive element and at least as a function of one degradation characteristic of a second temperature sensitive element.

15 Claims, 5 Drawing Sheets

U.S. PATENT DOCUMENTS

| | | | | |
|---|---|---|---|---|
| 4,530,234 | A | 7/1985 | Cullick et al. | 73/53 |
| 4,571,689 | A | 2/1986 | Hilderbrand et al. | 364/481 |
| 4,635,214 | A | 1/1987 | Kasai et al. | 364/551 |
| 4,642,782 | A | 2/1987 | Kemper et al. | 364/550 |
| 4,644,479 | A | 2/1987 | Kemper et al. | 364/550 |
| 4,649,515 | A | 3/1987 | Thompson et al. | 364/900 |
| 4,707,796 | A | 11/1987 | Calabro et al. | 364/552 |
| 4,736,367 | A | 4/1988 | Wroblewski et al. | 370/85 |
| 4,777,585 | A | 10/1988 | Kokawa et al. | 364/164 |
| 4,807,151 | A | 2/1989 | Citron | 364/510 |
| 4,831,564 | A | 5/1989 | Suga | 364/551.01 |
| 4,841,286 | A | 6/1989 | Kummer | 340/653 |
| 4,873,655 | A | 10/1989 | Kondraske | 364/553 |
| 4,907,167 | A | 3/1990 | Skeirik | 364/500 |
| 4,924,418 | A | 5/1990 | Backman et al. | 364/550 |
| 4,934,196 | A | 6/1990 | Romano | 73/861.38 |
| 4,939,753 | A | 7/1990 | Olson | 375/107 |
| 4,964,125 | A | 10/1990 | Kim | 371/15.1 |
| 4,988,990 | A | 1/1991 | Warrior | 340/25.5 |
| 4,992,965 | A | 2/1991 | Holter et al. | 364/551.01 |
| 5,005,142 | A | 4/1991 | Lipchak et al. | 364/550 |
| 5,019,760 | A | 5/1991 | Chu et al. | 318/490 |
| 5,043,862 | A | 8/1991 | Takahashi et al. | 364/162 |
| 5,053,815 | A | 10/1991 | Wendell | 355/208 |
| 5,067,099 | A | 11/1991 | McCown et al. | 364/550 |
| 5,081,598 | A | 1/1992 | Bellows et al. | 364/550 |
| 5,089,984 | A | 2/1992 | Struger et al. | 395/650 |
| 5,098,197 | A | 3/1992 | Shepard et al. | 374/120 |
| 5,099,436 | A | 3/1992 | McCown et al. | 364/550 |
| 5,103,409 | A | 4/1992 | Shimizu et al. | 364/556 |
| 5,111,531 | A | 5/1992 | Grayson et al. | 395/23 |
| 5,121,467 | A | 6/1992 | Skeirik | 395/11 |
| 5,122,794 | A | 6/1992 | Warrior | 340/825.2 |
| 5,122,976 | A | 6/1992 | Bellows et al. | 364/550 |
| 5,130,936 | A | 7/1992 | Sheppard et al. | 364/551.01 |
| 5,134,574 | A | 7/1992 | Beaverstock et al. | 364/551.01 |
| 5,137,370 | A | 8/1992 | McCullock et al. | 374/173 |
| 5,142,612 | A | 8/1992 | Skeirik | 395/11 |
| 5,143,452 | A | 9/1992 | Maxedon et al. | 374/170 |
| 5,148,378 | A | 9/1992 | Shibayama et al. | 364/551.07 |
| 5,167,009 | A | 11/1992 | Skeirik | 395/27 |
| 5,175,678 | A | 12/1992 | Frerichs et al. | 364/148 |
| 5,193,143 | A | 3/1993 | Kaemmerer et al. | 395/51 |
| 5,197,114 | A | 3/1993 | Skeirik | 395/22 |
| 5,197,328 | A | 3/1993 | Fitzgerald | 73/168 |
| 5,212,765 | A | 5/1993 | Skeirik | 395/11 |
| 5,214,582 | A | 5/1993 | Gray | 364/424.03 |
| 5,224,203 | A | 6/1993 | Skeirik | 395/22 |
| 5,228,780 | A | 7/1993 | Shepard et al. | 374/175 |
| 5,235,527 | A | 8/1993 | Ogawa et al. | 364/571.05 |
| 5,265,031 | A | 11/1993 | Malczewski | 364/497 |
| 5,265,222 | A | 11/1993 | Nishiya et al. | 395/3 |
| 5,269,311 | A | 12/1993 | Kirchner et al. | 128/672 |
| 5,274,572 | A | 12/1993 | O'Neill et al. | 364/550 |
| 5,282,131 | A | 1/1994 | Rudd et al. | 364/164 |
| 5,282,261 | A | 1/1994 | Skeirik | 395/22 |
| 5,293,585 | A | 3/1994 | Morita | 395/52 |
| 5,303,181 | A | 4/1994 | Stockton | 365/96 |
| 5,305,230 | A | 4/1994 | Matsumoto et al. | 364/495 |
| 5,311,421 | A | 5/1994 | Nomura et al. | 364/157 |
| 5,317,520 | A | 5/1994 | Castle | 364/482 |
| 5,327,357 | A | 7/1994 | Feinstein et al. | 364/502 |
| 5,333,240 | A | 7/1994 | Matsumoto et al. | 395/23 |
| 5,347,843 | A | 9/1994 | Orr et al. | 73/3 |
| 5,349,541 | A | 9/1994 | Alexandro, Jr. et al. | 364/578 |
| 5,357,449 | A | 10/1994 | Oh | 364/551.01 |
| 5,361,628 | A | 11/1994 | Marko et al. | 73/116 |
| 5,365,423 | A | 11/1994 | Chand | 364/140 |
| 5,367,612 | A | 11/1994 | Bozich et al. | 395/22 |
| 5,384,699 | A | 1/1995 | Levy et al. | 364/413.13 |
| 5,386,373 | A | 1/1995 | Keeler et al. | 364/577 |
| 5,394,341 | A | 2/1995 | Kepner | 364/551.01 |
| 5,394,543 | A | 2/1995 | Hill et al. | 395/575 |
| 5,404,064 | A | 4/1995 | Mermelstein et al. | 310/319 |
| 5,408,406 | A | 4/1995 | Mathur et al. | 364/163 |
| 5,408,586 | A | 4/1995 | Skeirik | 395/23 |
| 5,414,645 | A | 5/1995 | Hirano | 364/551.01 |
| 5,419,197 | A | 5/1995 | Ogi et al. | 73/659 |
| 5,430,642 | A | 7/1995 | Nakajima et al. | 364/148 |
| 5,440,478 | A | 8/1995 | Fisher et al. | 364/188 |
| 5,442,639 | A | 8/1995 | Crowder et al. | 371/20.1 |
| 5,467,355 | A | 11/1995 | Umeda et al. | 364/571.04 |
| 5,469,070 | A | 11/1995 | Koluvek | 324/713 |
| 5,469,156 | A | 11/1995 | Kogure | 340/870.38 |
| 5,469,735 | A | 11/1995 | Watanabe | 73/118.1 |
| 5,469,749 | A | 11/1995 | Shimada et al. | 73/861.47 |
| 5,481,199 | A | 1/1996 | Anderson et al. | 324/705 |
| 5,483,387 | A | 1/1996 | Bauhahn et al. | 359/885 |
| 5,485,753 | A | 1/1996 | Burns et al. | 73/720 |
| 5,486,996 | A | 1/1996 | Samad et al. | 364/152 |
| 5,488,697 | A | 1/1996 | Kaemmerer et al. | 395/51 |
| 5,489,831 | A | 2/1996 | Harris | 318/701 |
| 5,495,769 | A | 3/1996 | Broden et al. | 73/718 |
| 5,510,779 | A | 4/1996 | Maltby et al. | 340/870.3 |
| 5,511,004 | A | 4/1996 | Dubost et al. | 364/551.01 |
| 5,548,528 | A | 8/1996 | Keeler et al. | 364/497 |
| 5,561,599 | A | 10/1996 | Lu | 364/164 |
| 5,570,300 | A | 10/1996 | Henry et al. | 364/551.01 |
| 5,572,420 | A | 11/1996 | Lu | 364/153 |
| 5,573,032 | A | 11/1996 | Lenz et al. | 137/486 |
| 5,598,521 | A | 1/1997 | Kilgore et al. | 395/326 |
| 5,600,148 | A | 2/1997 | Cole et al. | 250/495.1 |
| 5,623,605 | A | 4/1997 | Keshav et al. | 395/200.17 |
| 5,637,802 | A | 6/1997 | Frick et al. | 73/724 |
| 5,640,491 | A | 6/1997 | Bhat et al. | 395/22 |
| 5,661,668 | A | 8/1997 | Yemini et al. | 364/550 |
| 5,665,899 | A | 9/1997 | Willcox | 73/1.63 |
| 5,669,713 | A | 9/1997 | Schwartz et al. | 374/1 |
| 5,671,335 | A | 9/1997 | Davis et al. | 395/23 |
| 5,675,504 | A | 10/1997 | Serodes et al. | 364/496 |
| 5,675,724 | A | 10/1997 | Beal et al. | 395/182.02 |
| 5,680,109 | A | 10/1997 | Lowe et al. | 340/608 |
| 5,700,090 | A | 12/1997 | Eryurek | 374/210 |
| 5,703,575 | A | 12/1997 | Kirpatrick | 340/870.17 |
| 5,704,011 | A | 12/1997 | Hansen et al. | 395/22 |
| 5,705,978 | A | 1/1998 | Frick et al. | 340/511 |
| 5,708,585 | A | 1/1998 | Kushion | 364/431.061 |
| 5,713,668 | A | 2/1998 | Lunghofer et al. | 374/179 |
| 5,719,378 | A | 2/1998 | Jackson, Jr. et al. | 219/497 |
| 5,741,074 | A | 4/1998 | Wang et al. | 374/185 |
| 5,742,845 | A | 4/1998 | Wagner | 395/831 |
| 5,746,511 | A | 5/1998 | Eryurek et al. | 374/2 |
| 5,752,008 | A | 5/1998 | Bowling et al. | 395/500 |
| 5,764,891 | A | 6/1998 | Warrior | 395/200.2 |
| 5,781,878 | A | 7/1998 | Mizoguchi et al. | 701/109 |
| 5,801,689 | A | 9/1998 | Huntsman | 345/329 |
| 5,805,442 | A | 9/1998 | Crater et al. | 364/138 |
| 5,828,567 | A | * 10/1998 | Eryurek et al. | 702/183 |
| 5,829,876 | A | 11/1998 | Schwartz et al. | 374/1 |
| 5,848,383 | A | 12/1998 | Yuuns | 702/102 |
| 5,859,964 | A | 1/1999 | Wang et al. | 395/185.01 |
| 5,876,122 | A | * 3/1999 | Eryurek | 374/183 |
| 5,887,978 | A | 3/1999 | Lunghofer et al. | 374/179 |
| 5,923,557 | A | 7/1999 | Eidson | 364/471.03 |
| 5,924,086 | A | 7/1999 | Mathur et al. | 706/25 |
| 5,926,778 | A | 7/1999 | Pöppel | 702/130 |
| 5,940,290 | A | 8/1999 | Dixon | 364/138 |
| 5,956,663 | A | 9/1999 | Eryurek et al. | 702/183 |
| 5,970,430 | A | 10/1999 | Burns et al. | 702/122 |
| 6,016,706 | A | 1/2000 | Yamamoto et al. | 9/6 |
| 6,017,143 | A | 1/2000 | Eryurek et al. | 700/51 |

| | | | | |
|---|---|---|---|---|
| 6,045,260 | A | 4/2000 | Schwartz et al. | 374/183 |
| 6,047,220 | A | 4/2000 | Eryurek et al. | 700/28 |
| 6,047,222 | A | 4/2000 | Burns et al. | 700/79 |
| 6,119,047 | A | 9/2000 | Eryurek et al. | 700/28 |
| 6,151,560 | A | 11/2000 | Jones | 702/58 |
| 6,192,281 | B1 | 2/2001 | Brown et al. | 700/2 |
| 6,195,591 | B1 | 2/2001 | Nixon et al. | 700/83 |
| 6,199,018 | B1 | 3/2001 | Quist et al. | 702/34 |
| 6,263,487 | B1 | 7/2001 | Stripf et al. | 717/1 |
| 6,298,377 | B1 | 10/2001 | Hartikainen et al. | 709/223 |

FOREIGN PATENT DOCUMENTS

| | | | |
|---|---|---|---|
| DE | 43 43 747 | | 6/1994 |
| DE | 44 33 593 | A1 | 6/1995 |
| DE | 195 02 499 | A1 | 8/1996 |
| DE | 296 00 609 | U1 | 3/1997 |
| DE | 197 04 694 | A1 | 8/1997 |
| DE | 19930660 | A1 | 7/1999 |
| DE | 299 17 651 | U1 | 12/2000 |
| EP | 0 122 622 | A1 | 10/1984 |
| EP | 0 413 814 | A1 | 2/1991 |
| EP | 0 487 419 | A2 | 5/1992 |
| EP | 0 594 227 | A1 | 4/1994 |
| EP | 0 624 847 | A1 | 11/1994 |
| EP | 0 644 470 | A2 | 3/1995 |
| EP | 0 825 506 | A2 | 7/1997 |
| EP | 0 827 096 | A2 | 9/1997 |
| EP | 0 838 768 | A2 | 9/1997 |
| EP | 0 807 804 | A2 | 11/1997 |
| EP | 1058093 | A1 | 5/1999 |
| FR | 2 302 514 | | 9/1976 |
| FR | 2 334 827 | | 7/1977 |
| GB | 928704 | | 6/1963 |
| GB | 1 534 280 | | 11/1978 |
| GB | 2 310 346 | A | 8/1997 |
| JP | 58-129316 | | 8/1983 |
| JP | 59-116811 | | 7/1984 |
| JP | 59-211196 | | 11/1984 |
| JP | 59-211896 | | 11/1984 |
| JP | 60-507 | | 1/1985 |
| JP | 60-76619 | | 5/1985 |
| JP | 60-131495 | | 7/1985 |
| JP | 62-30915 | | 2/1987 |
| JP | 64-1914 | | 1/1989 |
| JP | 64-72699 | | 3/1989 |
| JP | 2-5105 | | 1/1990 |
| JP | 5-122768 | | 5/1993 |
| JP | 06242192 | | 9/1994 |
| JP | 7-63586 | | 3/1995 |
| JP | 07234988 | | 9/1995 |
| JP | 8-54923 | | 2/1996 |
| JP | 8-136386 | | 5/1996 |
| JP | 8-166309 | | 6/1996 |
| JP | 08247076 | | 9/1996 |
| JP | 2712625 | | 10/1997 |
| JP | 2712701 | | 10/1997 |
| JP | 2753592 | | 3/1998 |
| JP | 07225530 | | 5/1998 |
| JP | 10-232170 | | 9/1998 |
| WO | WO 94/25933 | | 11/1994 |
| WO | WO 96/11389 | | 4/1996 |
| WO | WO 96/12993 | | 5/1996 |
| WO | WO 96/39617 | | 12/1996 |
| WO | WO 97/21157 | | 6/1997 |
| WO | WO 97/25603 | | 7/1997 |
| WO | WO 98/06024 | | 2/1998 |
| WO | WO 98/20469 | | 5/1998 |
| WO | WO 98/13677 | | 4/1999 |
| WO | WO 00/70531 | | 11/2000 |

OTHER PUBLICATIONS

U.S. patent application Ser. No. 09/855,179, Eryurek et al., filed May 14, 2001.

"Microsoft Press Computer Dictionary" 2nd Edition, 1994, Microsoft Press. p. 156.

"Improving Dynamic Performance of Temperature Sensors With Fuzzy Control Techniques," by Wang Lei et al., pp. 872–873 (1992).

U.S. patent application Ser. No. 09/576,719, Coursolle et al., filed May 23, 2000.

U.S. patent application Ser. No. 09/799,824, Rome et al., filed Mar. 05, 2001.

"A Microcomputer–Based Instrument for Applications in Platinum Resistance Thermomety," by H. Rosemary Taylor and Hector A. Navarro, Journal of Physics E. Scientific Instrument, vol. 16, No. 11, pp. 1100–1104 (1983).

"Experience in Using Estelle for the Specification and Verification of a Fieldbus Protocol: FIP," by Barretto et al., Computer Networking, pp. 295–304 (1990).

"Computer Simulation of H1 Field Bus Transmission," by Utsumi et al., Advances in Instrumentation and Control, vol. 46, Part 2, pp. 1815–1827 (1991).

"Progress in Fieldbus Developments for Measuring and Control Application," by A. Schwaier, Sensor and Acuators, pp. 115–119 (1991).

"Ein Emulationssystem zur Leistungsanalyse von Feldbussystemen, Teil 1," by R. Hoyer, pp. 335–336 (1991).

"Simulatore Integrato: Controllo su bus di campo," by Barabino et al., Automazione e Strumentazione, pp. 85–91 (Oct. 1993).

"Ein Modulares, verteiltes Diagnose–Expertensystem für die Fehlerdiagnose in lokalen Netzen," by Jürgen M. Schröder, pp. 557–565 (1990).

"Fault Diagnosis of Fieldbus Systems," by Jürgen Quade, pp. 577–581 (Oct. 1992).

"Ziele und Anwendungen von Feldbussystemen," by T. Pfeifer et al., pp. 549–557 (10/87).

"PROFIBUS–Infrastrukturmaβnahmen," by Tilo Pfeifer et al., pp. 416–419 (8/91).

"Simulation des Zeitverhaltens von Feldbussystemen," by O. Schnelle, pp. 440–442 (1991).

"Modelisation et simulation d'un bus de terrain: FIP," by Song et al, pp. 5–9 (undated).

"Feldbusnetz für Automatisierungssysteme mit intelligenten Funktionseinheiten," by W. Driesel et al., pp. 486–489 (1987).

"Bus de campo para la inteconexion del proceso con sistemas digitales de control," Tecnologia, pp. 141–147 (1990).

"Dezentrale Installation mit Echtzeit–Feldbus," Netzwerke, Jg. Nr. 3 v. 14.3, 4 pages (1990).

"Process Measurement and Analysis," by Liptak et al., Instrument Engineers' Handbook, Third Edit ion, pp. 528–530, (1995).

"A TCP/IP Tutorial" by, Socolofsky et al., Spider Systems Limited, Jan. 1991 pp. 1–23.

"Approval Standards For Explosionproof Electrical Equipment General Requirements", Factory Mutual Research, Cl. No. 3615, Mar. 1989, pp. 1–34.

"Approval Standard Intrinsically Safe Apparatus and Associated Apparatus For Use In Class I, II, and III, Division 1 Hazardous (Classified) Locations", Factory Mutual Research, Cl. No. 3610, Oct. 1988, pp. 1–70.

"Automation On–Line" by, Phillips et al., Plant Services, Jul. 1997, pp. 41–45.

"Climb to New Heights by Controlling your PLCs Over the Internet" by Phillips et al., Intech, Aug. 1998, pp. 50–51.
"CompProcessor For Piezoresistive Sensors" MCA Technologies Inc. (MCA7707), pp. 1–8. No Date.
"Ethernet emerges as viable, inexpensive fieldbus", Paul G. Schreier, Personal Engineering, Dec. 1997, pp. 23–29.
"Ethernet Rules Closed–loop System" by, Eidson et al., Intech, Jun. 1998, pp. 39–42.
"Fieldbus Standard for Use in Industrial Control Systems Part 2: Physical Layer Specification and Service Definition", ISA–S50.02–1992, pp. 1–93.
"Fieldbus Standard for Use in Industrial Control Systems Part 3: Data Link Service Definition", ISA–S50.02–1997, Part 3, Aug. 1997, pp. 1–159.
Fieldbus Standard For Use in Industrial Control Systems Part 4: Data Link Protocol Specificaiton, ISA–S50.02–1997, Part 4, Aug. 1997, pp. 1–148.
"Fieldbus Support For Process Analysis" by, Blevins et al., Fisher–Rosemount Systems, Inc., 1995, pp. 121–128.
"Fieldbus Technical Overview Understanding Foundation™ fieldbus technology", Fisher–Rosemount, 1998, pp. 1–23.
"Hypertext Transfer Protocol—HTTP/1.0" by, Berners–Lee et al., MIT/LCS, May 1996, pp. 1–54.
"Infranets, Intranets, and the Internet" by Pradip Madan, Echelon Corp, Sensors, Mar. 1997, pp. 46–50.
"Internet Technology Adoption into Automation" by, Fondl et al., Automation Business, pp. 1–5. No Date.
"Internet Protocol Darpa Internet Program Protocol Specification" by, Information Sciences Institute, University of Southern California, RFC 791, Sep. 1981, pp. 1–43.
"Introduction to Emit", emWare, Inc., 1997, pp. 1–22.
"Introduction to the Internet Protocols" by, Charles L. Hedrick, Computer Science Facilities Group, Rutgers University, Oct. 3, 1988, pp. 1–97.
"Is There A Future For Ethernet in Industrial Control?", Miclot et al., Plant Engineering, Oct. 1988, pp. 44–46, 48, 50.
LFM/SIMA Internet Remote Diagnostics Research Project Summary Report, Stanford University, Jan. 23, 1997, pp. 1–6.
"Managing Devices with the Web" by, Howard et al., Byte, Sep. 1997, pp. 45–64.
"Modular Microkernel Links GUI And Browser For Embedded Web Devices"by, Tom Williams, pp. 1–2. No Date.
"PC Software Gets Its Edge From Windows, Components, and the Internet", Wayne Labs, I&CS, Mar. 1997, pp. 23–32.
Proceedings Sensor Expo, Aneheim, California, Produced by Expocon Management Associates, Inc., Apr. 1996, pp. 9–21.
Proceedings Sensor Expo, Boston, Massachuttes, Produced by Expocon Management Associates, Inc., May 1997, pp. 1–416.
"Smart Sensor Network of the Future" by, Jay Warrior, Sensors, Mar. 1997, pp. 40–45.
"The Embedded Web Site" by, John R. Hines, IEEE Spectrum, Sep. 1996, pp. 23.
"Transmission Control Protocol: Darpa Internet Program Protocol Specification" Information Sciences Institute, Sep. 1981, pp. 1–78.
"Advanced Engine Diagnostics Using Universal Process Modeling", by P. O'Sullivan et al., *Presented at the 1996 SAE Conference on Future Transportion Technology,* pp. 1–9.
"On–Line Statistical Process Control for a Glass Tank Ingredient Scale," by R. A. Weisman, *IFAC real time Programming,* 1985, pp. 29–38.
"The Performance of Control Charts for Monitoring Process Variation," by C. Lowry et al., *Commun. Statis.—Simula.,* 1995, pp. 409–437.
"A Knowledge–Based Approach for Detection and Diagnosis of Out–Of–Control Events in Manufacturing Processes," by P. Love et al., *IEEE,* 1989, pp. 736–741.
"Advanced Engine Diagnostics Using Universal Process Modeling", by P. O'Sullivan *Presented at the 1996 SAE Conference on Future Transportation Technology,* pp. 1–9.
Parallel, Fault–Tolerant Control and Diagnostics System for Feedwater Regulation in PWRS, by E. Eryurek et al., *Proceedings of the American Power Conference.*
"Programmable Hardware Architecutres for Sensor Validation", by M.P. Henry et al., *Control Eng. Practice,* vol. 4, No. 10., pp. 1339–1354, (1996).
"Sensor Validation for Power Plants Using Adaptive Backpropagation Neural Network," *IEEE Transactions on Nuclear Science,* vol. 37, No. 2, by E. Eryurek et al. Apr. 1990, pp. 1040–1047.
"Signal Processing, Data Handling and Communications: The Case for Measurement Validation", by M.P. Henry, *Department of Engineering Science, Oxford University.* No Date.
"Smart Temperature Measurement in the '90s", by T. Kerlin et al., *C&I,* (1990).
"Software–Based Fault–Tolerant Control Design for Improved Power Plant Operation," *IEEE/IFAC Joint Symposium on Computer–Aided Control System Design,* Mar. 7–9, 1994 pp. 585–590.
A Standard Interface for Self–Validating Sensors, by M.P. Henry et al., *Report No. QUEL 1884/91*, (1991).
"Taking Full Advantage of Smart Transmitter Technology Now," by G. Orrison, *Control Engineering,* vol. 42, No. 1, Jan. 1995.
"Using Artificial Neural Networks to Identify Nuclear Power Plant States," by Israel E. Alguindigue et al., pp. 1–4. No Date.
"Application of Neural Computing Paradigms for Signal Validation," by B.R. Upadhaya et al., *Department of Nuclear Engineering,* pp. 1–18. No Date.
"Application of Neural Networks for Sensor Validation and Plant Monitoring," by B. Upadhyay et al., *Nuclear Technology,* vol. 97, No. 2, Feb. 1992 pp. 170–176.
"Automated Generation of Nonlinear System Characterization for Sensor Failure Detection," by B.R. Upadhyaya et al., *ISA,* 1989 pp. 269–274.
"In Situ Calibration of Nuclear Plant Platinum Resistance Thermometers Using Johnson Noise Methods," *EPRI,* Jun. 1983.
"Johnson Noise Thermometer for High Radiation and High–Temperature Environments," by L. Oakes et al., *Fifth Symposium on Space Nuclear Power Systems,* Jan. 1988, pp. 2–23.
"Development of a Resistance Thermometer For Use Up to 1600° C.", by M.J. de Groot et al., *CAL LAB,* Jul./Aug. 1996, pp. 38–41.
"Survey, Applications, And Prospects of Johnson Noise Thermometry," by T. Blalock et al., *Electrical Engineering Department,* 1981, pp. 2–11.

"Noise Thermometry for Industrial and Metrological Applications at KFA Julich," by H. Brixy et al., *7th International Symposium on Temperature,* 1992.
"Johnson Noise Power Thermometer and its Application in Process Temperature Measurement," by T.V. Blalock et al., *American Institute of Physics* 1982, pp. 1249–1259.
"Field–based Architecture is Based on Open Systems, Improves Plant Performance", by P. Cleaveland, *I&CS,* Aug. 1996, pp. 73–74.
"Tuned–Circuit Dual–Mode Johnson Noise Thermometers," by R.L. Shepard et al., Apr. 1992.
"Tuned–Circuit Johnson Noise Thermometry," by Michael Roberts et al., *7th Symposium on Space Nuclear Power Systems,* Jan. 1990.
"Smart Field Devices Provide New Process Data, Increase System Flexibility," by Mark Boland, *I&CS,* Nov. 1994, pp. 45–51.
"Wavelet Analysis of Vibration, Part I: Theory[1]," by D.E. Newland, *Journal of Vibration and Acoustics,* vol. 116, Oct. 1994, pp. 409–416.
"Wavelet Analysis of Vibration, Part 2: Wavelet Maps," by D.E. Newland, *Journal of Vibration and Acoustics,* vol. 116, Oct. 1994, pp. 417–425.
"Development of a Long–Life, High–Reliability Remotely Operated Johnson Noise Thermometer," by R.L. Shepard et al., *ISA,* 1991, pp. 77–84.
"Application of Johnson Noise Thermometry to Space Nuclear Reactors," by M.J. Roberts et al., *Presented at the 6th Symposium on Space Nuclear Power Systems,* Jan. 9–12, 1989.
"A Decade of Progress in High Temperature Johnson Noise Thermometry," by T.V. Blalock et al., *American Institute of Physics,* 1982 pp. 1219–1223.
"Sensor and Device Diagnostics for Predictive and Proactive Maintenance", by B. Boynton, *A Paper Presented at the Electric Power Research Institute—Fossil Plant Maintenance Conference* in Baltimore, Maryland, Jul. 29–Aug. 1, 1996, pp. 50–1–50–6.
"Detection of Hot Spots in Thin Metal Films Using an Ultra Sensitive Dual Channel Noise Measurement System," by G.H. Massiha et al., *Energy and Information Technologies in the Southeast,* vol. 3 of 3, Apr. 1989, pp. 1310–1314.
"Detecting Blockage in Process Connections of Differential Pressure Transmitters", by E. Taya et al., *SICE,* 1995, pp. 1605–1608.
"Development and Application of Neural Network Algorithms For Process Diagnostics," by B.R. Upadhyaya et al., *Proceedings of the 29th Conference on Decision and Control,* 1990, pp. 3277–3282.
"A Fault–Tolerant Interface for Self–Validating Sensors", by M.P. Henry, *Colloquium,* pp. 3/1–3/2 (Nov. 1990).
"Fuzzy Logic and Artificial Neural Networks for Nuclear Power Plant Applications," by R.C. Berkan et al., *Proceedings of the American Power Conference.* No Date.
"Fuzzy Logic and Neural Network Applications to Fault Diagnosis", by P. Frank et al., *International Journal of Approximate Reasoning,* (1997), pp. 68–88.
"Keynote Paper: Hardware Compilation–A New Technique for Rapid Prototyping of Digital Systems–Applied to Sensor Validation", by M.P. Henry, *Control Eng. Practice,* vol. 3, No. 7., pp. 907–924, (1995).
"The Implications of Digital Communications on Sensor Validation", by M. Henry et al., *Report No. QUEL 1912/92,* (1992).
"In–Situ Response Time Testing of Thermocouples", *ISA,* by H.M. Hashemian et al., Paper No. 89–0056, pp. 587–593, (1989).
"An Integrated Architecture For Signal Validation in Power Plants," by B.R. Upadhyaya et al., *Third IEEE International Symposium on Intelligent Control,* Aug. 24–26, 1988, pp. 1–6.
"Integration of Multiple Signal Validation Modules for Sensor Monitoring," by B. Upadhyaya et al., *Department of Nuclear Engineering,* Jul. 8, 1990, pp. 1–6.
"Intelligent Behaviour for Self–Validating Sensors", by M.P. Henry, *Advances In Measurement,* pp. 1–7, (May 1990).
"Measurement of the Temperature Fluctuation in a Resistor Generating 1/F Fluctuation," by S. Hashiguchi, *Japanese Journal of Applied Physics,* vol. 22, No. 5, Part 2, May 1983, pp. L284–L286.
"Check of Semiconductor Thermal Resistance Elements by the Method of Noise Thermometry", by A. B. Kisilevskii et al., *Measurement Techniques,* vol. 25, No. 3, Mar. 1982, New York, USA, pp. 244–246.
"Neural Networks for Sensor Validation and Plant Monitoring," by B. Upadhyaya, *International Fast Reactor Safety Meeting,* Aug. 12–16, 1990, pp. 2–10.
"Neural Networks for Sensor Validation and Plantwide Monitoring," by E. Eryurek, 1992.
"A New Method of Johnson Noise Thermometry", by C.J. Borkowski et al., *Rev. Sci. Instrum.,* vol. 45, No. 2, (Feb. 1974) pp. 151–162.
"Thermocouple Continuity Checker," IBM Technical Disclosure Bulletin, vol. 20, No. 5, pp. 1954 (Oct. 1977).
"A Self–Validating Thermocouple," Janice C–Y et al., IEEE Transactions on Control Systems Technology, vol. 5, No. 2, pp. 239–253 (Mar. 1997).
*Instrument Engineers' Handbook,* Chapter IV entitled "Temperature Measurements," by T.J. Claggett, pp. 266–333 (1982).
"emWare's Releases EMIT 3.0, Allowing Manufacturers to Internet and Network Enable Devices Royalty Free," 3 pages, PR Newswire (Nov. 4, 1998).
Warrior, J., "The IEEE P1451.1 Object Model Network Independent Interfaces for Sensors and Actuators," pp. 1–14, Rosemount Inc. (1997).
Warrior, J., "The Collison Between the Web and Plant Floor Automation," 6*Th*. WWW Conference Workshop on Embedded Web Technology, Santa Clara, CA (Apr. 7, 1997).
Microsoft Press Computer Dictionary, 3*rd* Edition, p. 124.
"Internal Statistical Quality Control for Quality Monitoring Instruments", by P. Girling et al., *ISA,* 15 pp. 1999.
Web Pages from www.triant.com (3 pgs.). No Date.
"Statistical Process Control (Practice Guide Series Book)", *Instrument Society of America,* 1995, pp. 1–58 and 169–204.
"Time–Frequency Analysis of Transient Pressure Signals for a Mechanical Heart Valve Cavitation Study," *ASAIO Journal,* by Alex A. Yu et al., vol. 44, No. 5, pp. M475–M479, (Sep.–Oct. 1998).
"Transient Pressure Signals in Mechanical Heart Valve Caviation," by Z.J. We et al., pp. M555–M561 (undated).
"Caviation in Pumps, Pipes and Valves," *Process Engineering,* by Dr. Ronald Young, pp. 47 and 49 (Jan. 1990).
"Quantification of Heart Valve Cavitation Based on High Fidelity Pressure Measurements," *Advances in Bioengineering 1994,* by Laura A. Garrison et al., BED–vol. 28, pp. 297–298 (Nov. 6–11, 1994).

"Monitoring and Diagnosis of Cavitation in Pumps and Valves Using the Wigner Distribution," Hydroaccoustic Facilities, Instrumentation, and Experimental Techniques, NCA–vol. 10, pp. 31–36 (1991).
"Developing Predictive Models for Cavitation Erosion," *Codes and Standards in A Global Environment,* PVP–vol. 259, pp. 189–192 (1993).
"Self–Diagnosing Intelligent Motors: A Key Enabler for Next Generation Manufacturing System," by Fred M. Discenzo et al., pp. 3/1–3/4 (1999).
U.S. patent application Ser. No. 09/169,873, Eryurek et al., filed Oct. 12, 1998.
U.S. patent application Ser. No. 09/175,832, Eryurek et al., filed Oct. 19, 1998.
U.S. patent application Ser. No. 09/257,896, Eryurek et al., filed Feb. 25, 1999.
U.S. patent application Ser. No. 09/303,869, Eryurek et al., filed May 03, 1999.
U.S. patent application Ser. No. 09/335,212, Kirkpatrick et al., filed Jun. 17, 1999.
U.S. patent application Ser. No. 09/344,631, Eryurek et al., filed Jun. 25, 1999
U.S. patent application Ser. No. 09/360,473, Eryurek et al., filed Jul. 23, 1999.
U.S. patent application Ser. No. 09/369,530, Eryurek et al., filed Aug. 06, 1999.
U.S. patent application Ser. No. 09/383,828, Eryurek et al., filed Aug. 27, 1999.
U.S. patent application Ser. No. 09/384,876, Eryurek et al., filed Aug. 27, 1999.
U.S. patent application Ser. No. 09/406,263, Kirkpatrick et al., filed Sep. 24, 1999.
U.S. patent application Ser. No. 09/409,098, Eryurek et al., filed Sep. 30, 1999.
U.S. patent application Ser. No. 09/409,114, Eryurek et al., filed Sep. 30, 1999.
U.S. patent application Ser. No. 09/565,604, Eruyrek et al., filed Sep. 04, 2000.
U.S. patent application Ser. No. 09/576,450, Wehrs, filed May 23, 2000.
U.S. patent application Ser. No. 09/616,118, Eryurek et al., filed Jul. 14, 2000.
U.S. patent application Ser. No. 09/627,543, Eryurek et al., filed Jul. 28, 2000.

* cited by examiner

LOW POWER TWO-WIRE SELF VALIDATING TEMPERATURE TRANSMITTER

This application claims benefit of provisional application No. 60/141,963 filed Jul. 1, 1999.

BACKGROUND OF THE INVENTION

The process industry employs process variable transmitters to monitor process variables associated with substances such as solids, slurries, liquids, vapors, and gasses in chemical, pulp, petroleum, pharmaceutical, food and other processing plants. Process variables include pressure, temperature, flow, level, turbidity, density, concentration, chemical composition and other properties.

In typical processing plants, a communication bus, such as a 4–20 mA current loop is used to power the process variable transmitter. Examples of such current loops include a FOUNDATION™ Fieldbus connection or a connection in accordance with the Highway Addressable Remote Transducer (HART) communication protocol. In transmitters powered by a two-wire loop, power must be kept low to comply with intrinsic safety requirements.

A process temperature transmitter provides an output related to a sensed process substance temperature. The temperature transmitter output can be communicated over the loop to a control room, or the output can be communicated to another process device such that the process can be monitored and controlled. In order to monitor a process temperature, the transmitter includes a sensor, such as a resistance temperature device (RTD) or a thermocouple.

An RTD changes resistance in response to a change in temperature. By measuring the resistance of the RTD, temperature can be calculated. Such resistance measurement is generally accomplished by passing a known current through the RTD, and measuring the associated voltage developed across the RTD.

A thermocouple provides a voltage in response to a temperature change. The Seebeck Effect provides that dissimilar metal junctions create voltage due to the union of the dissimilar metals in a temperature gradient condition. Thus, the voltage measured across the thermocouple will relate to the temperature of the thermocouple.

As temperature sensors age, their accuracy tends to degrade until the sensor ultimately fails. However, small degradations in the output from the sensor are difficult to detect and to separate from actual changes in the measured temperature. In the past, temperature transmitters have used two temperature sensors to detect sensor degradation. If the output from the two sensors is not in agreement, the temperature transmitter can provide an error output. However, this technique is not able to detect a degradation in the sensor output if both of the two temperature sensors degrade at the same rate and in the same manner.

One technique which has been used in situations in which power is not a constraint is described in U.S. Pat. Nos. 5,713,668 and 5,887,978, issued Feb. 3, 1998 and Mar. 30, 1999, respectively, to Lunghofer et al. and entitled "SELF-VERIFYING TEMPERATURE SENSOR" each of which is herein incorporated fully by reference. These references describe a temperature sensor having multiple outputs. The multiple outputs all vary as functions of temperature. However, the relationships between the various outputs and temperature are not the same. Further, the various elements in the temperature sensor change over time at differing rates, and in differing manners and react differently to various types of failures. A computer monitors the output from the sensor using a multiplexer. The computer places data points from the sensor into a matrix. By monitoring the various entries in the matrix and detecting changes in the various element or elements of the matrix relative to other elements, the computer provides a "confidence level" output for the measured temperature. If the confidence level exceeds a threshold, an alarm can be provided.

However, the art of low power process variable transmitters has an ongoing need for improved temperature sensors such as those which provide improved accuracy or a diagnostic output indicative of the condition of the temperature sensor.

SUMMARY OF THE INVENTION

A two-wire temperature transmitter is coupleable to a two-wire process control loop for measuring a process temperature. The transmitter includes an analog to digital converter configured to provide digital output in response to an analog input. A two-wire loop communicator is configured to couple to the process control loop and send information on the loop. A microprocessor is coupled to the digital output and configured to send temperature related information on the process control loop with the two-wire loop communicator. A power supply is configured to completely power the two-wire temperature transmitter with power from the two-wire process control loop. A temperature sensor comprises at least two temperature sensitive elements having element outputs which degrade in accordance with different degradation characteristics. The element outputs are provided to the analog to digital converter, such that the microprocessor calculates temperature related information as a function of at least one element output from a first temperature sensitive element and at least as a function of one degradation characteristic of a second temperature sensitive element.

DETAILED DESCRIPTION OF THE ILLUSTRATIVE EMBODIMENTS

Figure 1:
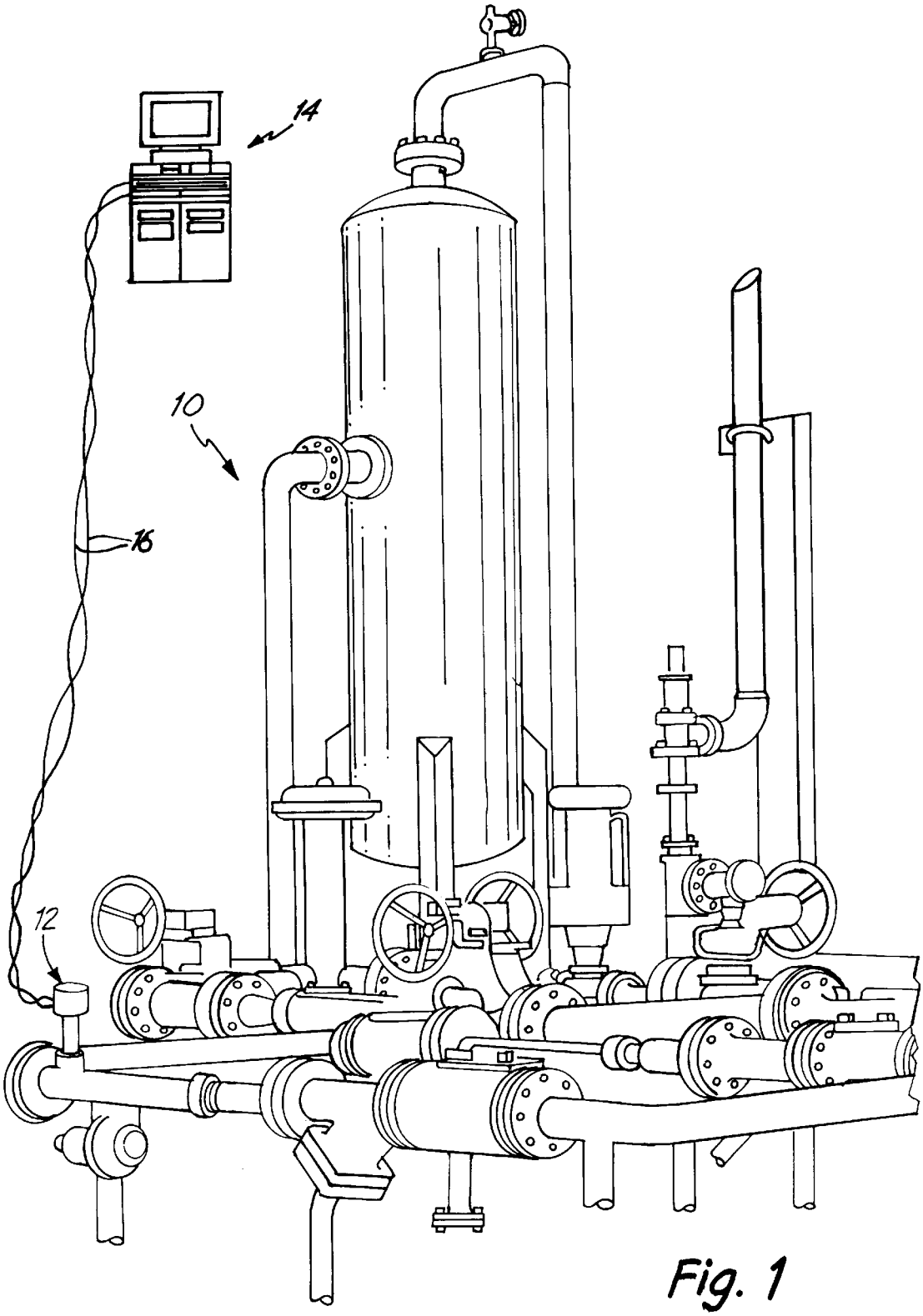
FIG. 1 is a diagram of the environment of a process temperature transmitter.
Figure 2:
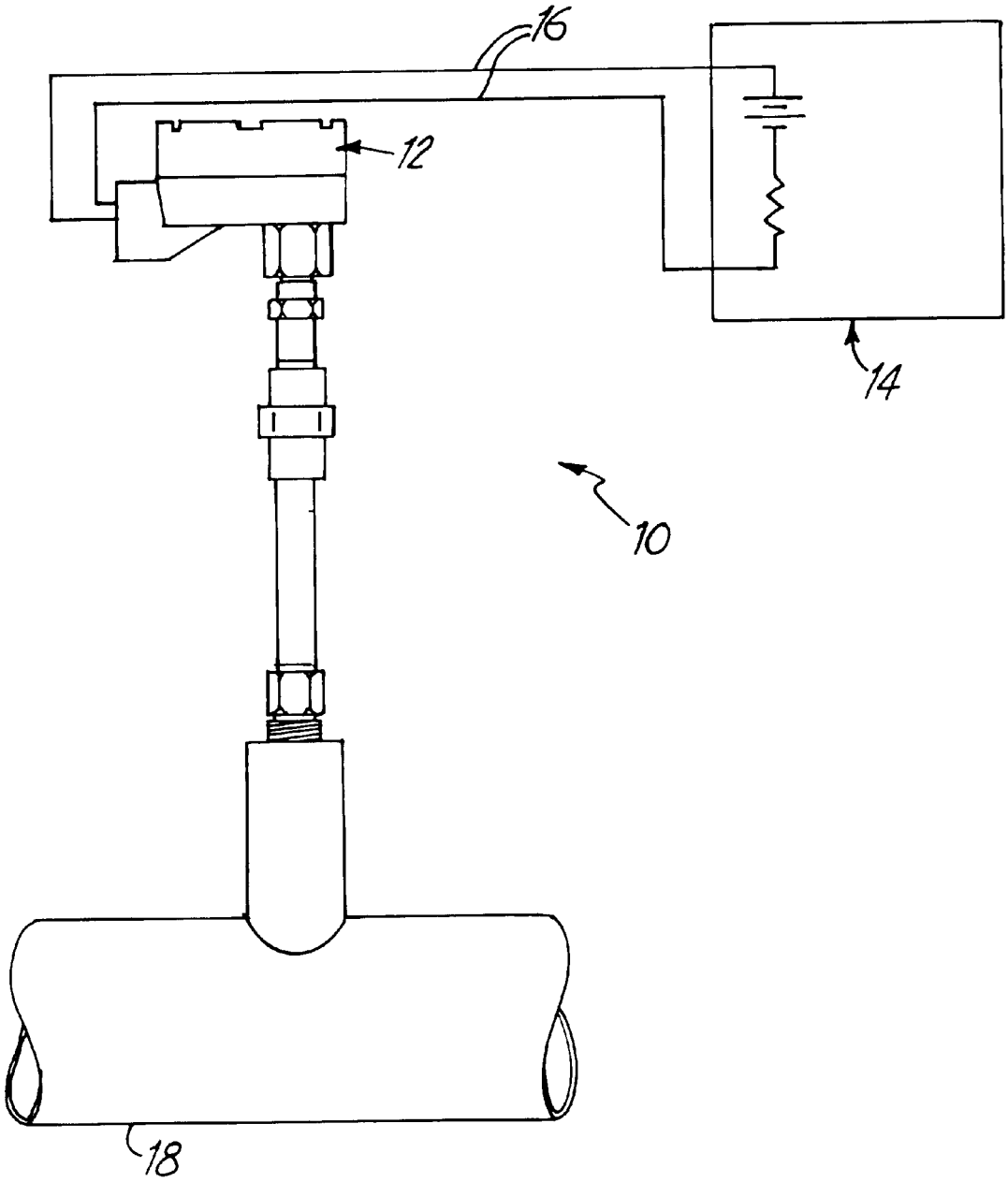
FIG. 2 is a diagrammatic view of the process temperature transmitter of FIG. 1.

FIGS. 1 and 2 illustrate the environment of a process temperature transmitter in accordance with embodiments of the invention. FIG. 1 shows process control system 10 including process temperature transmitter 12, two-wire process control loop 16 and monitor 14. As used herein, two-wire process control loop means a communication channel including two wires that power connected process devices and provide for communication between the connected devices.

FIG. 2 illustrates process control system 10 including process temperature transmitter 12 electrically coupled to monitor 14 (modeled as a voltage source and resistance) over two-wire process control loop 16. Transmitter 12 is mounted on and coupled to a process fluid container such as pipe 18. Transmitter 12 monitors the temperature of process fluid in process pipe 18 and transmits temperature information to monitor 14 over loop 16.

Figure 3:
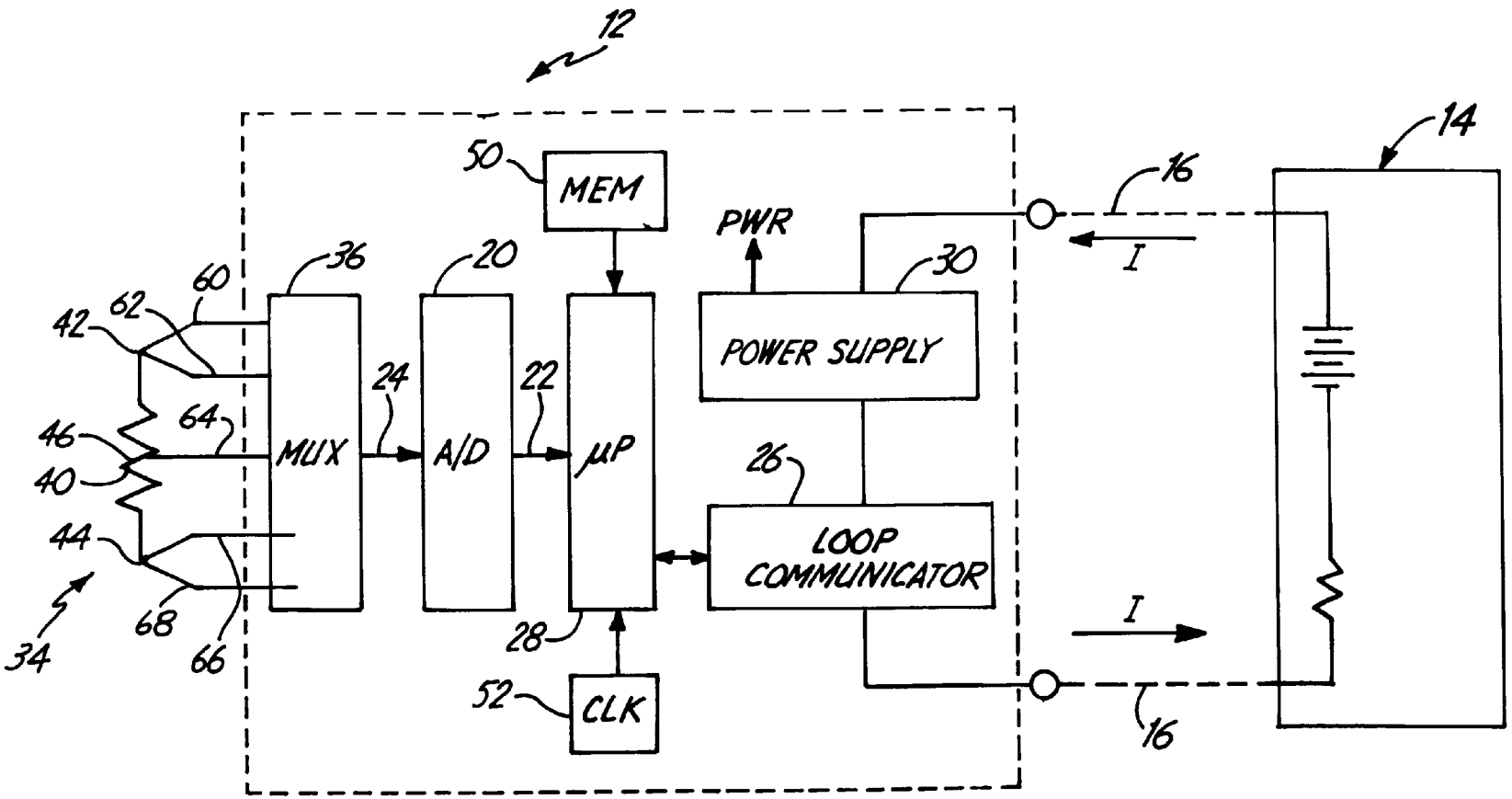
FIG. 3 is a system block diagram of a process temperature transmitter.

FIG. 3 is a system block diagram of process temperature transmitter 12 in accordance with an embodiment of the invention. Process temperature transmitter 12 includes an analog to digital converter 20 configured to provide a digital output 22 in response to an analog input 24. A two-wire loop communicator 26 is configured to couple to two-wire process control loop 16 and to send information on loop 16 from a microprocessor 28. At least one power supply 30 is configured to couple to loop 16 to receive power solely from loop 16 and provide a power output (Pwr) to power circuitry in transmitter 12 with power received from loop 16. A temperature sensor 34 couples to analog to digital converter 20 through multiplexer 36 which provides the analog signal 24. Temperature sensor 34 includes temperature sensitive elements such as RTD 40 and thermocouples 42, 44 and 46. Temperature sensor 34 operates in accordance with the techniques described in U.S. Pat. No. 5,713,668. In addition to the transmitter shown in FIG. 3, the teachings of U.S. Pat. No. 5,828,567 to Eryurek et al., entitled "DIAGNOSTICS FOR RESISTANCE BASED TRANSMITTER" can be used with sensor 34, which patent is herein incorporated fully by reference.

Microprocessor 28 can be a low power microprocessor such as a Motorola 6805HC11 available from Motorola Inc. In many microprocessor systems, a memory 50 is included in the microprocessor which operates at a rate determined by clock 52. Memory 50 includes both programming instructions for microprocessor 28 as well as temporary storage for measurement values obtained from temperature sensor 34, for example. The frequency of clock 52 can be reduced to further reduce power consumption of microprocessor 28.

Loop communicator 26 communicates on two-wire process control loop 16 in accordance with known protocols and techniques. For example, communicator 26 can adjust the loop current I in accordance with a process variable received from microprocessor 28 such that current I is related to the process variable. For example, a 4 mA current can represent a lower value of a process variable and 20 mA current can represent an upper value for the process variable. In another embodiment, communicator 26 impresses a digital signal onto loop current I and transmits information in a digital format. Further, such digital information can be received from two-wire process control loop 16 by communicator 26 and provided to microprocessor 28 to control operation of temperature transmitter 12.

Analog to digital converter 20 operates under low power conditions. One example of analog to digital converter 20 is a sigma-delta converter. Examples of analog to digital converters used in process variable transmitters are described in U.S. Pat. No. 5,803,091, entitled "CHARGE BALANCE FEEDBACK MEASUREMENT CIRCUIT" issued Jan. 21, 1992 and U.S. Pat. No. 4,878,012, entitled "CHARGE BALANCE FEEDBACK TRANSMITTER, issued Oct. 31, 1989, which are commonly assigned with the present application and are incorporated herein by reference in their entirety.

Sensor 34 includes at least two temperature sensitive elements each having element outputs that degrade in accordance with different degradation characteristics. As illustrated, sensor 34 includes conductors 60, 62, 64, 66 and 68. In one embodiment, at least some of conductors 60–68 are dissimilar conductors which have temperature related characteristics which change in a dissimilar manner. For example, conductors 60 and 62 can be of dissimilar metals such that they form a thermocouple at junction 42. Using multiplexer 36, various voltage and resistance measurements of sensor 34 can be made by microprocessor 28. Further, a four point Kelvin connection to RTD 40 through conductors 60, 62, 66 and 68 is used to obtain an accurate measurement of the resistance of RTD 40. In such a measurement, current is injected using, for example, conductors 60 and 68 into RTD 40 and conductors 62 and 66 are used to make a voltage measurement. Conductor 64 can also be used to make a voltage measurement at some midpoint in RTD 40. Voltage measurements can also be made between any pair of conductors such as conductors 60/62 60/64, 62/66, etc. Further still, various voltage or resistance measurements can be combined to obtain additional data for use by microprocessor 28.

Microprocessor 28 stores the data points in memory 50 and operates on the data in accordance with the techniques described in U.S. Pat. Nos. 5,713,668 and 5,887,978. This is used to generate a process variable output related to temperature which is provided to loop communicator 26. For example, one of the elements in sensor 34 such as RTD 40 can be the primary element while the remaining temperature related data points provide secondary data points. Microprocessor 28 can provide the process variable output along with an indication of the confidence level, probability of accuracy or a temperature range, i.e., plus or minus a certain temperature amount or percentage based upon the secondary data points. For example, the process variable output can be output as an analog signal (i.e., between 4 and 20 mA) while the indication of confidence can be provided as a digital signal. The confidence indication can be generated by empirical measurements in which all of the data outputs are observed over a wide range of temperatures and as the elements begin to degrade with time or other failures. Microprocessor 28 can compare actual measurements with the characteristics stored in memory 50 which have been generated using the empirical tests. Using this technique, anomalous readings from one or more of the data measurements can be detected. Depending on the severity of the degradation, microprocessor 28 can correct the temperature output to compensate for the degraded element. For a severely degraded element, microprocessor 28 can indicate that the sensor 34 is failing and that the temperature output is inaccurate.

Microprocessor 28 can also provide a process variable output as a function of the primary sensor element and one or more secondary sensor elements. For example, the primary sensor element can be an RTD indicating a temperature of for example 98° C. while a secondary sensor element, for example a type J thermocouple, may indicate a temperature of 100° C., giving each sensor an equal numeric weight would provide a process temperature output of 99° C. Because various types of sensors and sensor families exhibit different electrical characteristics in varying temperature ranges, microprocessor 28 can be programmed to vary sensor element weighting based upon the process variable itself. Thus, as the measured temperature begins to exceed a useful range of one type of sensor, the weighting for that sensor can be reduced or eliminated such that additional sensors with higher useful temperature ranges can be relied upon. Moreover, because various types of sensors and sensor families have different time constants, it is contemplated that the weighting factors can be changed in response to a rate of change of the measured temperature. For example, an RTD generally has more thermal mass than a thermocouple due to the sheer mass of wound sensor wire and the fact that the sensor wire is generally wound around a ceramic bobbin which provides yet additional thermal mass. However, the thermocouple junctions may have significantly less thermal mass than the RTD and thus track rapid temperature changes more effectively than the RID. Thus, as microprocessor 28 begins to detect a rapid temperature change. The sensor element weights can be adjusted such that the process variable output relies more heavily upon thermocouples.

Figure 4:
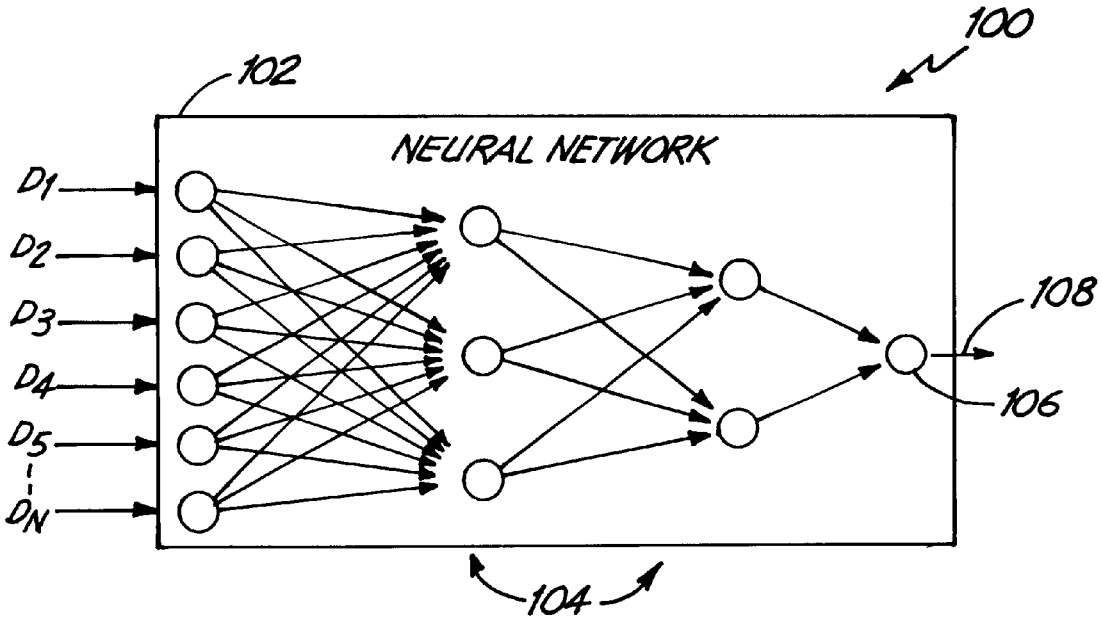
FIG. 4 is a diagram of a neural network implemented in the transmitter of FIG. 3.

In one embodiment, software in memory 50 is used to implement a neural network in microprocessor 28 such as neural network 100 illustrated in FIG. 4. FIG. 4 illustrates a multi-layer neural network. Neural network 100 can be trained using known training algorithms such as the back propagation network (BPN) to develop the neural network modules. The network includes input nodes 102, hidden nodes 104 and output node 106. Various data measurements $D_I$–$D_N$ are provided as inputs to the input nodes 102 which act as an input. buffer. The input nodes 102 modify the received data by various weights in accordance with a training algorithm and the outputs are provided to the hidden nodes 104. The hidden layer 104 is used to characterize and analyze the non-linear properties of the sensor 34. The last layer, the output layer 106 provides an output 108 which is an indication of the accuracy of the temperature measurement. Similarly, an additional output can be used to provide an indication of the sensed temperature.

The neural network 100 can be trained either through modeling or empirical techniques in which actual sensors are used to provide training inputs to the neural network 100. Additionally, a more probable estimate of the process temperature can be provided as the output based upon operation of the neural network upon the various sensor element signals.

Another technique for analyzing the data obtained from sensor 34 is through the use of a rule based system in which memory 50 contains rules, expected results and sensitivity parameters.

Figure 5:
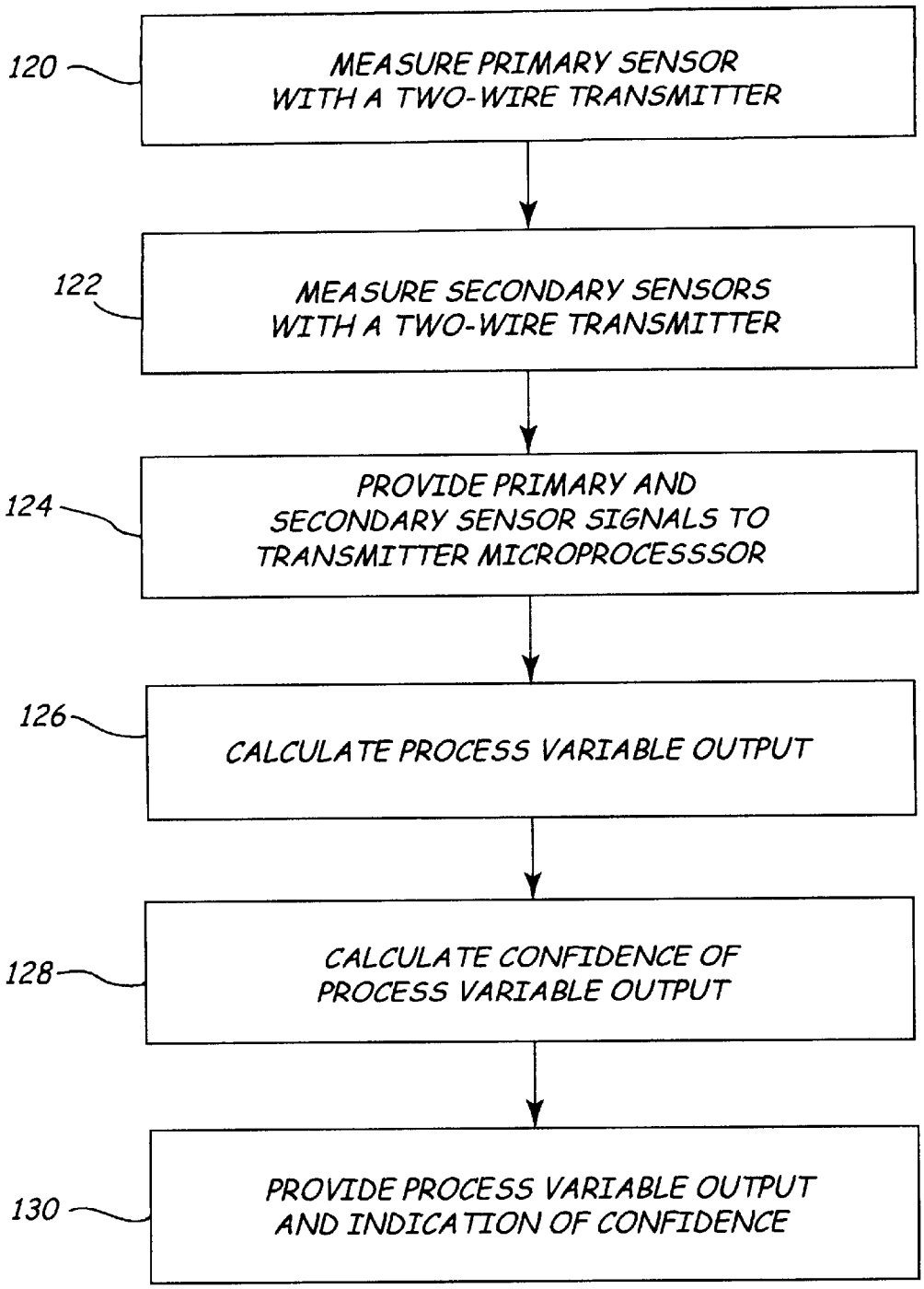
FIG. 5 is a block diagram of a method of measuring process fluid temperature with a two-wire process temperature transmitter.

FIG. 5 is a block diagram of a method of measuring process temperature with a two-wire process temperature transmitter. The method begins at block 120 where a primary sensor element is measured using a two-wire temperature transmitter, such as transmitter 12. At block 122, one or more secondary sensor elements are measured using the two-wire temperature transmitter. It should be noted that block 122 need not be performed after each and every primary sensor element measurement, but that block 122 can be performed periodically or in response to an external command. At block 124, the primary sensor element and secondary sensor element signals are provided to a transmitter microprocessor, such as microprocessor 28 (shown in FIG. 3). At block 126, microprocessor 28 calculates a process variable output based upon one or more of the primary sensor element signal and secondary sensor element signals. At block 128, the microprocessor calculates a confidence of the process variable output based upon the primary element sensor signal and one or more of the secondary sensor element signals. Finally, at block 130, the process temperature output and an indication of output validation or confidence in the process temperature output are provided by the two-wire process temperature transmitter. Such indication can be in the form of a numeric value representing a tolerance, or probability of accuracy or a temperature range, i.e., plus or minus a certain temperature amount or percentage based upon one or more secondary sensor signals; or the indication can also be an alarm or other user notification representative of the acceptability of the process variable output. Additionally, the indication of confidence can be in the form of an estimation of time remaining until the two-wire process transmitter is unable to suitably relate the process variable output to the process temperature. Further, providing a validated process temperature allows validation and diagnostics of other process variables that can be affected by the process temperature.

Another analysis technique is fuzzy logic. For example, fuzzy logic algorithms can be employed on the data measurements $D_I$–$D_N$ prior to their input into neural network 100 of FIG. 4. Additionally, neural network 100 can implement a fuzzy-neural algorithm in which the various neurons of the network implement fuzzy algorithms. The various analysis techniques can be used alone or in their combinations. Additionally, other analysis techniques are considered to be within the scope of the present invention so long as they reach the requirement that the system is capable of operating completely from power received from a two-wire process control loop.

Although only a single analog to digital converter 20 is shown, such an analog to digital converter can comprise multiple analog to digital converters which can thereby either reduce or eliminate the amount of multiplexing performed when coupling the sensor 34 to the analog to digital converters.

Although the invention has been described with reference to preferred embodiments, workers skilled in the art will recognize that changes can be made in form and detail without departing from the spirit and scope of the invention. For example, various function blocks of the invention have been described in terms of circuitry, however, many function blocks may be implemented in other forms such as digital and analog circuits, software and their hybrids. When implemented in software, a microprocessor performs the functions and the signals comprise digital values on which the software operates. A general purpose processor programmed with instructions that cause the processor to perform the desired process elements, application specific hardware components that contain circuits wired to perform the desired elements and any combination of programming a general purpose processor and hardware components can be used. Deterministic or fuzzy logic techniques can be used as needed to make decisions in the circuitry or software. Because of the nature of complex digital circuitry, circuit elements may not be partitioned into separate blocks as shown, but components used for various functional blocks can be intermingled and shared. Likewise with software, some instructions can be shared as part of several functions and be intermingled with unrelated instructions within the scope of the invention.

What is claimed is:

1. A two-wire temperature transmitter coupleable to a two-wire process control loop for measuring temperature of a process, comprising:

at least one power supply configured to couple to the two-wire process control loop, the at least one power supply receiving power solely from the process control loop to power the two-wire temperature transmitter;

a two-wire loop communicator configured to couple to the two-wire process control loop and at least send information on the loop;

a temperature sensor comprising at least two temperature sensitive elements each having element outputs which elements degrade in accordance with different degradation characteristics;

an analog to digital converter coupled to the element outputs and configured to provide digital output in response to an analog input;

a microprocessor coupled to the digital output and configured to send temperature related information on the two-wire process control loop to the two-wire loop communicator, wherein the microprocessor calculates temperature related information as a function of at least one element output from a first temperature sensitive element and at least as a function of one degradation characteristic of at least a second temperature sensitive element.

2. The transmitter of claim 1, wherein the loop communicator is configured to communicate the temperature related information and validation information on the process control loop.

3. The transmitter of claim 1, when the microprocessor is further adapted to provide a confidence level for the temperature related information as a function of the degradation characteristic of the at least second temperature sensitive element.

4. The transmitter of claim 1 wherein the microprocessor is further adapted to provide a probability of accuracy for the temperature related information based upon the degradation characteristic of the at least second temperature sensitive element.

5. The transmitter of claim 1, wherein the microprocessor is further adapted to provide an indication of range in the form of +/− percentage for the temperature related information as a function of the degradation characteristic of the at least second temperature sensitive element.

6. The transmitter of claim 3, wherein the confidence level is based at least in part upon empirical data.

7. The transmitter of claim 1, wherein the temperature related information is calculated as a function of at least one element output from the first temperature sensitive element and at least as a function of one degradation characteristic of at least a second temperature sensitive element, and wherein each of the first temperature sensitive element and second temperature sensitive element are weighted with a weight that varies with the process variable.

8. The transmitter of claim 1, wherein the temperature related information is calculated as a function of at least one element output from the first temperature sensitive element and at least as a function of one degradation characteristic of at least a second temperature sensitive element, and wherein each of the first temperature sensitive element and second temperature sensitive element are weighted with a weight that varies with the rate of change of the process variable.

9. The transmitter of claim 1, wherein the microprocessor is adapted to calculate the temperature related information based upon a neural network analysis.

10. The transmitter of claim 9, wherein the neural network analysis employed by the microprocessor is generated with empirical data.

11. The transmitter of claim 1, wherein the temperature related information is calculated as a function of a rule-based system.

12. The transmitter of claim 1, wherein the temperature related information is calculated as a function of a fuzzy logic algorithm implemented by the microprocessor.

13. A method of measuring process temperature with a two-wire temperature transmitter, the method comprising:

measuring a primary sensor element of a temperature sensor with the two-wire temperature transmitter, to provide a primary sensor signal;

measuring at least one secondary sensor element with the two-wire temperature transmitter to obtain at least one secondary sensor signal;

providing the primary and secondary sensor signals to a transmitter microprocessor;

calculating a process temperature based at least upon the primary sensor element;

calculating a confidence of the process temperature based upon the primary sensor signal and one or more of the secondary sensor signals; and providing a validated process temperature output based on the temperature output and the confidence.

14. The method of claim 13, and further comprising providing a validated process variable output based upon the validated process temperature.

15. A two-wire transmitter coupleable to a two-wire process control loop for measuring temperature of a process, the transmitter comprising:

power supply means coupleable to the two-wire process control loop to supply power to the temperature transmitter;

loop communication means configured to communicate over the two-wire process control loop;

temperature sensing means;

measurement means coupled to the temperature sensing means to provide data indicative of a temperature of the temperature sensing means; and computing means coupled to the measurement means, the computing means for computing a process temperature based upon at least two temperature sensitive elements having different degradation characteristics.

* * * * *